US005513566A

United States Patent [19]

Lehmann et al.

[11] Patent Number: 5,513,566

[45] Date of Patent: May 7, 1996

[54] ROTARY PRINTING MACHINE

[75] Inventors: Rolf Lehmann, Rudolfstetten; Eugen Schnyder, Waltenschwil, both of Switzerland

[73] Assignee: Sulzer-Escher Wyss AG, Zurich, Switzerland

[21] Appl. No.: 167,928

[22] PCT Filed: Jun. 23, 1993

[86] PCT No.: PCT/CH93/00162

§ 371 Date: Dec. 29, 1993

§ 102(e) Date: Dec. 29, 1993

[87] PCT Pub. No.: WO93/21015

PCT Pub. Date: Oct. 28, 1993

[30] Foreign Application Priority Data

Nov. 9, 1992 [CH] Switzerland ..... 03455/92

[51] Int. Cl.[6] ..... B41F 9/14

[52] U.S. Cl. ..... 101/156; 101/168

[58] Field of Search ..... 101/155, 156, 101/157, 154, 162, 167, 348, 349, 350, 153, 168; 492/2, 6, 7

[56] References Cited

U.S. PATENT DOCUMENTS

| | | | |
|---|---|---|---|
| 1,115,127 | 10/1914 | Stickney | 101/156 |
| 2,997,951 | 8/1961 | Huck | 101/156 |
| 3,853,698 | 12/1974 | Mohr | 492/7 X |

FOREIGN PATENT DOCUMENTS

| | | | |
|---|---|---|---|
| 439822 | 8/1991 | European Pat. Off. . | |
| 1140206 | 7/1963 | Germany . | |
| 1460785 | 3/1969 | Germany . | |
| 2421099 | 11/1975 | Germany . | |
| 2054464 | 2/1981 | United Kingdom | 101/153 |

*Primary Examiner*—Christopher A. Bennett
*Attorney, Agent, or Firm*—Greenblum & Bernstein

[57] ABSTRACT

In a rotary printing machine the printing cylinder (1) is supported on a flexible band (6) under tension, printing ink being introduced into the gap (8) between the band (6) and the printing cylinder. This facilitates the hydraulic mounting of the printing cylinder (1) while reducing the load on the cylinder shaft journal mounting (2) and prevents deformation of the cylinder, and also ensures even ink coverage of the printing cylinder surface.

15 Claims, 2 Drawing Sheets

ROTARY PRINTING MACHINE

TECHNICAL FIELD

This invention pertains to a rotary printing machine having a printing cylinder, pressable relative to a counter roller, which is provided with an ink supplying apparatus for supplying printing ink to the surface of the printing cylinder.

STATE OF THE PRIOR ART

Such printing machines, particularly rotogravure printing machines are described in many publications, for example, as described in Bruckmann's Handbuch der Drucktechnik, (Handbook of Printing Techniques by the Bruckmann Publishing Co.), published in Munich, in 1976.

In order to print more economically, there is a need to build wider printing machines of that type, and to increase the printing width as well as the printing speeds, that is to increase the number of revolutions of the printing cylinder. Rotary printing machines of the noted construction do not fulfill these requirements or only in a limited manner, due to the following reasons:

Printing cylinders of greater width, particularly those with a small circumference, deflect under pressure, to such an extent, that the movement of the paper is disturbed via the formation of folds. In addition, as a consequence of the deflection, the applied printing ink is no longer uniformly removed, across the entire width of the printing cylinder, by the squeegees.

The rolling element bearings of the printing cylinder become overloaded due the higher pressure loads and the higher number of revolutions, which often leads to early failure of the bearings.

The filling of the gravure wells or recesses on the surface of the printing cylinders can no longer be fully assured at the higher paper speeds, since the immersion time of the generally utilized ink containers is too short, and since, at the higher number of revolutions, the increased centrifugal force, works against the wetting by means of the printing ink.

DESCRIPTION OF THE INVENTION

The invention has the task, to avoid the previously-noted disadvantages of the prior art, and particularly, in a rotary printing machine of the initially-described type, to totally avoid or keep within limits, the deflection of the printing cylinder even at increased widths and with all utilized diameters, to relieve the bearing pressure of the printing cylinders and to assure the dependable filling of the gravure wells on the surface of the printing cylinder, with printing ink in a short time.

In accordance with this invention, this task is resolved in that the printing cylinder is supported on at least one tensioned flexible band, wherein printing ink is supplied into a gap between the band and the printing cylinder, over the surface of the printing cylinder upon the band, wherein at the same time, a hydraulic lubrication layer for the bearing means of the printing cylinder is formed upon the band.

The flexible band can extend across the entire width of the printing cylinder or the printing web, or several laterally adjacent bands are provided whereby differing printing colors can be applied, independently of each other, upon different width portions of the printing cylinder.

It is an advantage to vary the length of the flexible band with an applicable apparatus so that the wrap angle of the band about the printing cylinder can be set and the band can be accommodated to differing diameters of the printing cylinder.

It is of particular advantage to journal the ends of the printing cylinder in a machine frame, in connection with which the journals are provided with an arrangement for measuring the bearing forces. The part, over which the flexible band is tensioned, is advantageously formed as a carriage movable in the press direction within a machine frame and is pressed, via a placement apparatus that is controlled via a bearing sensor, against the pressing cylinder with such force so as to unload the printing cylinder bearings and that the force is taken up practically only through the nearly friction free and low wearing hydraulic journalling of the printing cylinder upon the flexible band. This means that the deflection forces operating in the printing cylinder are compensated in their extent and direction.

The carriage can additionally carry out a slow oscillating movement in the direction of the axis of the printing cylinder in order to prohibit a striation of the printing layer.

In an advantageous further embodiment of this invention, the flexible band can also be shaped as an endless band which is guided over several deflection rolls. In this way the band can, via the deflection rolls, be movable relative to the surface of the printing cylinder. The axial positions of the deflection rolls are advantageously changeable for the adjustment of the wrapping angle and/or the applied pressure.

BRIEF DESCRIPTION OF THE DRAWINGS

The invention will now be more fully described with reference to the several embodiments set forth in the drawings. It is shown in.

MODES OF CARRYING OUT THE INVENTION

Figure 1:
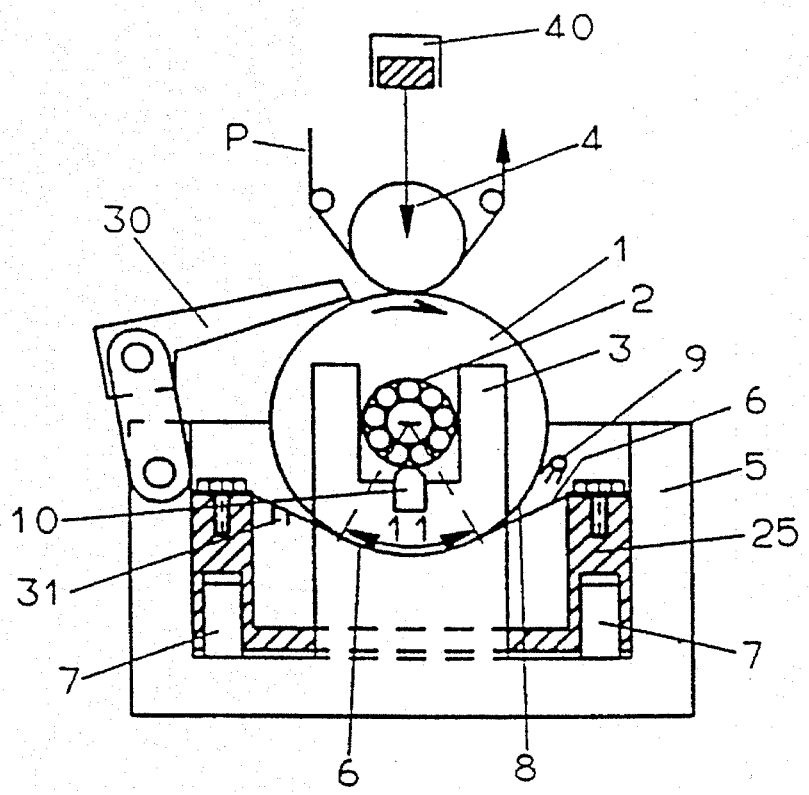
FIG. 1, a rotary printing machine, in section, vertically relative to the axis.

FIG. 1 shows a rotary printing machine having a form or printing cylinder 1, which carries a printing form on its surface and which cooperates with a pressing cylinder or counter roller 4 to imprint, with a determined printing pressure, a printing web P, for example of paper, plastic or a weave, that travels between printing cylinder 1 and pressing cylinder 4.

Printing cylinder 1 which includes a printing form having, for example, a gravure or engraving, is provided with rolling element bearings 2 on its journal ends. Printing cylinder 1 is so positioned in the printing machine, via rolling element bearings 2, of guide pieces 5 in the sides of the printing machine, that printing cylinder 1 can be moved, for example vertically, in the direction of pressing cylinder 4. A flexible band 6 is stretched across movable carriage 25, within machine frame 5, beneath printing cylinder 1, across the entire width of printing cylinder 1. This band can, for example, be an elastic metallic foil, a weave, or a combination of different materials or the like, wherein this band must exhibit such flexibility that it can accommodate itself to the radius of the printing cylinder over a certain wrap angle 11 when counter roller 4 and printing cylinder 1 are pressed together. This can, for example, be accomplished via hydraulic cylinder 7 on carriage 25, with which carriage 25 is pressed in the direction of printing cylinder 1.

Printing ink is supplied into a gap 8, between printing cylinder 1 and flexible band 6, via distribution pipe 9, with the printing ink being carried, via the rotation of driven printing cylinder 1, beneath printing cylinder 1 and which, as a result of the hydrodynamic forces, in the region of wrap angle 11, forms a lubricating gap which separates band 6 from printing cylinder 1 via a film of printing ink.

Load cells 10, provided beneath the printing cylinder bearings, measure the engagement pressure of bearings, consisting of the weight of printing cylinder 1 and the printing pressure of pressure cylinder 4 which is produced by clamping cylinder 40. The pressure exerted by cylinders 7 is so controlled by the output signal of load cells 10 that band 6 is pressed against printing cylinder 1 in such a manner that load cells 10 are unloaded. This means that the pressures that act on printing cylinder 1 which cause deformation of the cylinder, are compensated so that printing cylinder 1, for all practical purposes, is no longer deformed.

The hydrodynamically produced force, in the gap between band 6 and the surface of printing cylinder 1, acts in accordance with the laws of hydrodynamic bearing lubrication, in a distributed manner over wrap angle 11 of band 6. Thereby, the printing ink, which simultaneously forms the lubricating means between band 6 and printing cylinders 1, is channelled under pressure, to an exactly defined region of the gravure cells of the printing cylinder, so that the gravure cells are totally filled, even at high printing speeds. Squeegees 30, behind the engagement gap, remove all superfluous ink from the printing cylinder. The thusly removed printing ink is carried back, via bores 31 in the band, to carriage 25, with carriage 25 also serving as an ink reservoir.

Band 6 or carriage 25 can make a slow oscillating movement C, with a low amplitude, relative to in the axial direction of printing cylinder 1 in order to achieve, across the width thereof, an especially even ink covering while avoiding striations.

Figure 2:
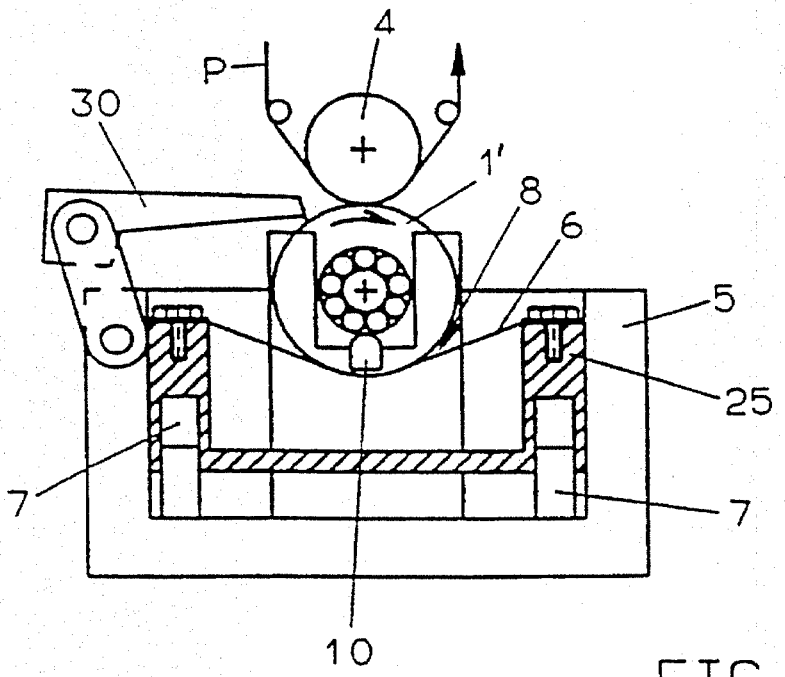
FIG. 2, a rotary printing machine with a printing cylinder having a different diameter.

FIG. 2 shows the construction of the rotary printing machine depicted in FIG. 1 with a printing cylinder 1' of a smaller diameter. Due to the conformability of flexible band 6, relative to printing cylinder 1', it is possible to utilize printing cylinders of differing diameters in the same printing machine without having to undertake expensive conversion tasks during the change of the printing cylinder, inasmuch as only carriage 25, via hydraulic cylinder 7, is shifted for the dimension of the difference of the radii of printing cylinders 1 and 1'.

Figure 3:
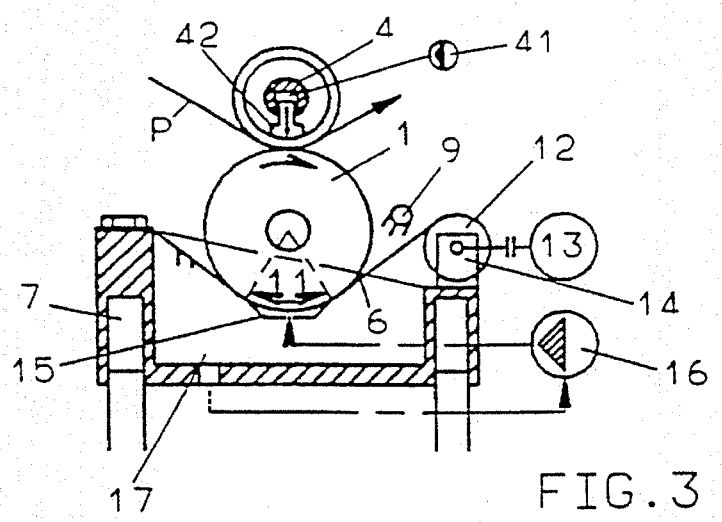
FIG. 3, a rotary printing machine having a variable band length.

FIG. 3 shows an arrangement of carriage 25 by means of which band 6 is attached on one end of a drum 12 which permits, via the winding up of band 6, to vary the active length of band 6. In this way it is possible, together with pressure cylinders 7, to adjust wrap angle 11 of band 6 about printing cylinder 1, so as to achieve an optimization between the friction of the band bearings and the filling of the gravure cells. Drum 12 is driven by a motor or by hand via a transmission 14. A particularly advantageous embodiment results when motor 13 is so constructed as to produce an adjustable constant torque, whose extent can be readjusted until load cells 10 are compensated and the printing cylinder shows no further deformation.

FIG. 3 additionally shows the construction of the band bearing as a hydrostatic bearing in place of the hydrodynamic bearing of the previous examples. Thereby, across the width of the printing cylinder, several spaced bearing pockets 15 are incorporated into band 6, into which pockets printing ink is supplied , under pressure, via individual pumps 16, from ink or dye reservoir 17. This arrangement has the advantages that, via regulation of the pump capacities, the gap height of the lubricating gap between band 6 and printing cylinder 1 can be set and varied, which is not readily possible with a hydrodynamic bearing. Therewith, the energy requirement of the printing cylinder drive can be affected, i.e., it can be reduced. In addition, the lubricating gap between band 6 and printing cylinder 1, is assured even during standstill of the machine, so that even at stillstand or at startup of the machine there is no contact between band 6 and printing cylinder 1, thereby obviating any possible damage of the gravure. When pressing cylinder 4 is, for example, constructed as a printing roller of the type set forth in European Patent Publication No. EP 439 822, the hydraulic pressure of pump 41 for support elements 42, can be so controlled in that the relationship of the oil pressure of pressing cylinders 7 relative to the forces acting upon the printing cylinder from the bottom and from the top are the same, thus cancelling the deflection forces.

Figure 4:
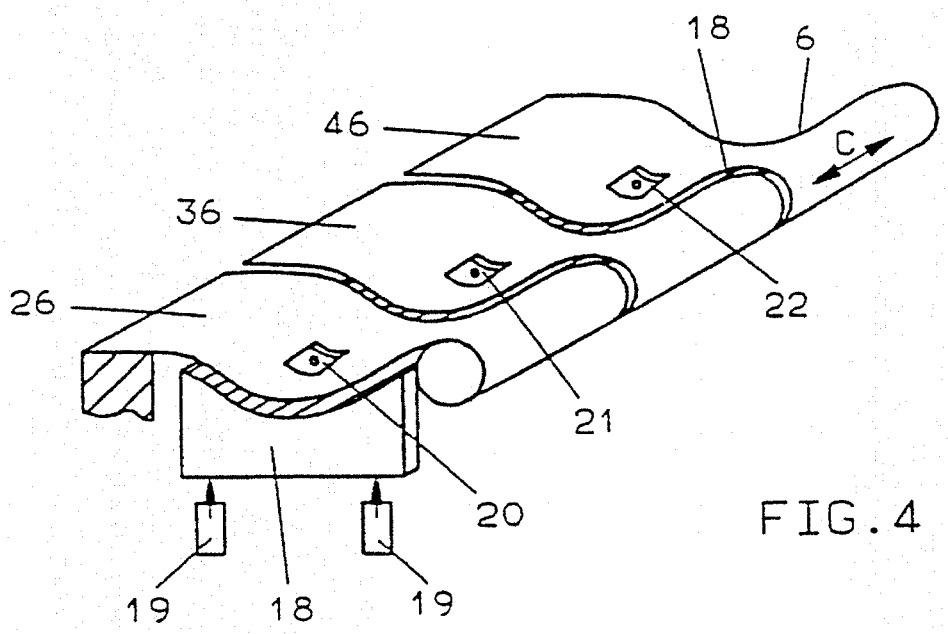
FIG. 4, a rotary printing machine having several laterally adjacent bands.

FIG. 4 shows a band bearing, comprised of several laterally adjacent single bands 26, 36, 46, wherein the band width is chosen so it corresponds with that of a page to be printed. A sealing strip 18 is provided between each of individual bands 26, 36, 46 which is pressed against printing cylinder 1, for example, with hydraulic cylinders 19. Differing colors can be forced into bearing pockets 20, 21, 22 in individual bands 26, 36, 46 via associated single pumps, with these colors being kept separate via sealing strips 18. With this arrangement it is possible, for example, in the last printing station of a rotogravure printing machine, to print differing decorative colors with only one printing cylinder, which is a great advantage, especially for advertisements.

Figure 5:
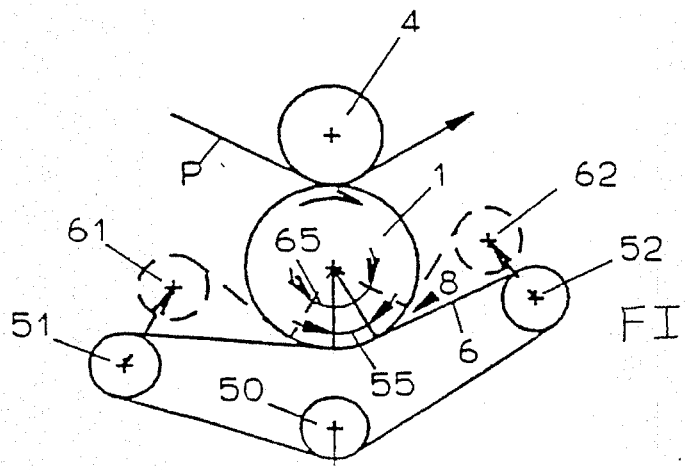
FIG. 5, a rotary printing machine having an endless, flexible band.

FIG. 5 shows a construction, in which flexible band 6 takes the form of an endless band, which is movably guided over several deflection rolls 50, 51, 52. With a large diameter, two deflection rolls can be sufficient, normally however three or more rolls are required. Band 6 is advantageously movable relative to the surface of printing cylinder 1. Via the selection or the setting of the relative speed, between band 6 and the surface of the printing cylinder, the amount or layer thickness of the applied printing ink can be influenced or controlled in a relatively simple manner. The directions of movement of band 6 and printing cylinder 1 can also be opposite to each other (reverse rolling) or also in the same direction with differing speed. It can also be an advantage when band 6 and the surface of the printing cylinder move at at least approximately the same speed, whereby an abrasion and scratching of the surface of the printing cylinder through hard particles, washed into gap 8 between band 6 and printing cylinder 1, can be avoided.

The spatial positions of the axes of deflection rolls 50, 51, 52 can be adjustable. Thereby, on one hand, the applied pressure of band 6 onto printing cylinder 1 can be varied and adjusted, and on the other hand, upon need, the wrap angle of band 6 at printing cylinder 1, can be changed via a positional change of the deflection rolls, from positions 51, 52 having an extent or value 55 to position 61, 62 having a different extent or value 65.

The arrangement of deflection rolls 51, 52 can also be nonsymmetrical, for example of a type so that the run between band 6 and printing cylinder 1 becomes relatively flat. In this manner, any foreign particles that have entered gap 8 can easily and readily be swept out therefrom. scratching of the surface of the printing cylinder through hard particles, washed into gap 8 between band 6 and printing cylinder 1, can be avoided.

The spatial positions of the axes of deflection rolls 50, 51, 52 can be adjustable. Thereby, on one hand, the applied pressure of band 6 onto printing cylinder 1 can be varied and adjusted, and on the other hand, upon need, the wrap angle of band 6 at printing cylinder 1, can be changed via a positional change of the deflection rolls, from positions 51, 52 having an extent or value 55 to position 61, 62 having a different extent or value 65.

The arrangement of deflection rolls 51, 52 can also be nonsymmetrical, for example of a type so that the run between band 6 and printing cylinder 1 becomes relatively flat. In this manner, any foreign particles that have entered gap 8 can easily and readily be swept out therefrom.

Even in this construction, over the width of the printing cylinders, several endless individual, laterally adjacent bands can be provided in lieu of a single endless band.

We claim:

1. A rotary printing machine having a printing cylinder (1), pressable relative to a counter roller (4), which is provided with at least one flexible band (6) and with an ink supplying apparatus (9) for supplying printing ink to the surface of the pressing cylinder (1), wherein the printing cylinder (1) is supported upon the at least one tensioned flexible band (6), and wherein printing ink is supplied into a gap (8) between the band (6) and the printing cylinder (1), with the printing ink being distributed, during the rotation of the printing cylinders (1), over the surface of the printing cylinder (1), at an engaging surface of the printing cylinder (1) upon the band (6), wherein, at the same time, hydraulic lubrication for bearing means of the printing cylinder (1) is formed upon the band (6).

2. The rotary printing machine of claim 1, wherein the flexible band (6) extends across the entire width of the printing cylinder (1).

3. The rotary printing machine of claim 1, wherein several laterally adjacent bands (26, 36, 46) are provided across the width of the printing cylinder (1).

4. The rotary printing machine of claim 1, wherein the printing ink is supplied into the gap (8) between the band (6) and the printing cylinder (1), with the printing ink forming a hydrodynamic bearing for the printing cylinder (1) upon the band (6).

5. The rotary printing machine of claim 1, wherein the band (6) includes at least one hydrostatic bearing pocket (15), with the printing ink being supplied to the at least one bearing pocket (15) under pressure and the bearing pocket forming, with the printing ink, a hydrostatic bearing for the printing cylinder (1) upon the band (6).

6. The rotary printing machine of claim 1, further including a machine carriage, a machine frame, and hydraulic elements wherein the band is stretched across the machine carriage and wherein the active length of the band (6) is variable by movement of the machine carriage, via movement of the hydraulic elements in a press direction within the machine frame.

7. The rotary printing machine of claim 6, further including a windup drum (12) wherein at least one end of the band is secured on the windup drum (12).

8. The rotary printing machine of claim 1, further including a machine frame, a carriage (25) and hydraulic cylinders, wherein the band is secured to the carriage (25) with the carriage being movable via pressure applied in a press direction within the machine frame (5).

9. The rotary printing machine of claim 1, further including several deflection rolls, wherein the band (6) is an endless band, with the band being guided over several the deflection rolls (50, 51, 52).

10. The rotary printing machine of claim 9, wherein the band (6) is movable relative to the surface of the printing cylinder (1) via a spatial adjustment of at least one of the several deflection rolls (50, 51, 52).

11. The rotary printing machine of claim 9, wherein the band is moved at least approximately at the same speed and in the same direction as the surface of the printing cylinder (1).

12. The rotary printing machine of claim 9, wherein the axial position of at least one of the deflection rolls (50, 51, 52) is spatially changeable.

13. The rotary printing machine of claim 1, wherein the ends of the printing cylinder (1) include bearings (2), with the bearings in turn including a load (10) cell for measuring the bearing pressures.

14. The rotary printing machine of claim 13, further including a machine frame, hydraulic cylinders and a plurality of deflection rolls, wherein the load cell (10) is adapted, via the hydraulic cylinders to control at least one of the length of the band (6), and the applied pressure to the carriage (25) within the frame (5) and the position of at least one of the plurality of deflection rolls (50, 51, 52), so as to relieve the load on the bearings on the ends of the printing cylinder.

15. The rotary printing machine of claim 1, wherein the band (6) is subjected to an oscillating movement (C) in the axial direction of the printing cylinder (1).

* * * * *